US005534972A

United States Patent [19]

Ohno

[11] Patent Number: 5,534,972

[45] Date of Patent: Jul. 9, 1996

[54] IMAGE FORMING APPARATUS HAVING A ROTATABLE IMAGE BEARING MEMBER SUPPORTED AND POSITIONED RELATIVE TO A MAIN BODY OF THE APPARATUS BY A SHAFT AND IMAGE FORMING MEANS POSITIONED RELATIVE TO THE SHAFT

[75] Inventor: Akio Ohno, Yokohama, Japan

[73] Assignee: Canon Kabushiki Kaisha, Tokyo, Japan

[21] Appl. No.: 170,780

[22] Filed: Dec. 21, 1993

[30] Foreign Application Priority Data

Dec. 24, 1992 [JP] Japan ..... 4-357299
Dec. 8, 1993 [JP] Japan ..... 5-308046

[51] Int. Cl.[6] ..... G03G 15/00

[52] U.S. Cl. ..... 355/200; 355/211; 355/245

[58] Field of Search ..... 355/245, 210, 355/211, 215, 212, 200, 260, 326 R, 327

[56] References Cited

U.S. PATENT DOCUMENTS

| | | | |
|---|---|---|---|
| 4,271,786 | 6/1981 | Buckley et al. | 355/245 X |
| 4,432,632 | 2/1984 | Yokota | 355/212 X |
| 4,469,430 | 9/1984 | Terashima | 355/215 X |
| 4,547,059 | 10/1985 | Nagayama et al. | 355/212 |
| 4,676,627 | 6/1987 | Ohno . | |
| 4,866,482 | 9/1989 | Hirasawa et al. | 355/260 |
| 4,951,093 | 8/1990 | Ishii et al. | 355/245 |
| 5,014,094 | 5/1991 | Amitani et al. | 355/200 X |
| 5,142,322 | 8/1992 | Surti | 355/200 |
| 5,151,734 | 9/1992 | Tsuda et al. | 355/200 |
| 5,182,601 | 1/1993 | Hodoshima et al. | 355/245 X |
| 5,321,469 | 6/1994 | Ahn | 355/211 |

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

An image forming apparatus has a rotation shaft which supports an image bearing body and positions the image bearing body and image forming device when they are detachably mounted on the main body. The image forming device includes a frame that have bearings for supporting the shaft of the image bearing body. The image bearing body and a rotating body of the image forming device are separately rotated and do not come into contact with each other via spacer rollers. Accordingly, the mechanical vibration of the rotating body is not transmitted to the image bearing body, and an image can be obtained without defects caused by the mechanical vibration.

24 Claims, 7 Drawing Sheets

IMAGE FORMING APPARATUS HAVING A ROTATABLE IMAGE BEARING MEMBER SUPPORTED AND POSITIONED RELATIVE TO A MAIN BODY OF THE APPARATUS BY A SHAFT AND IMAGE FORMING MEANS POSITIONED RELATIVE TO THE SHAFT

BACKGROUND OF THE INVENTION

1. Field of the Invention

The present invention relates to an image forming apparatus for a copying machine, a printer, and so on.

2. Related Background Art

An image forming apparatus using electrophotography has been known, which has a photosensitive drum serving as an image bearing body around which there are provided image forming means such as: a charger means for uniformly charging the photosensitive drum; an exposure means for forming a latent image by illuminating the charged photosensitive drum with light; a developer means for visualizing the latent image with a developer; and a transfer means for transferring the visualized image from the photosensitive drum to a recording medium.

The developer means, for example, sprays the developer from a developer sleeve onto the photosensitive drum. Alternately, the developer may be formed in the shape of a brush on the developer sleeve so as to come into contact with the surface of the photosensitive drum. To obtain good development using either method, the narrow clearance between the surface of the developer sleeve and that of the photosensitive drum must be maintained with high precision.

A developer means has been put to practical use which has rollers at both ends of the developer sleeve, wherein the diameter of the rollers is larger than that of the developer sleeve. The rollers come into contact with respective end portions of the photosensitive drum in order to obtain a predetermined clearance between the surface of the photosensitive drum and that of the developer sleeve.

However, in the arrangement where the spacer rollers are in contact with the photosensitive drum, the mechanical vibration generated when the developer sleeve is driven is transmitted to the photosensitive drum through the rollers. The vibration acts as a load preventing smooth rotation of the photosensitive drum. As a result, the obtained image has defects caused by nonuniformity of the pitch, enlargement or reduction of the image, and so on. Especially in case of a full-color image forming apparatus provided with a plurality of process units, such nonuniformity of the pitch and enlargement or reduction of the image, and so on, result in an image which is irregularly colored and blurred.

As described above, the image forming means arranged close around the image bearing body should act on the image bearing body with high precision, wherein the image bearing body can be easily shaken by the image forming means.

SUMMARY OF THE INVENTION

An object of the present invention devised to solve the above-mentioned problem is to provide an image forming apparatus in which the mechanical vibration caused when the developer sleeve is rotated is not transmitted from the developer sleeve to the image bearing body.

Another object of the present invention is to provide an image forming apparatus in which the image bearing body and the developer means which are detachably mounted on the apparatus main body are positioned by the rotation shaft of the image bearing body.

Still another object of the present invention is to provide an image forming apparatus which can adjust the distance between the surface of the image bearing body and that of the developer sleeve to a predetermined value, without using spacer rollers, or the like, simply by mounting the image bearing body and the developer means on the apparatus main body.

Other objects of the present invention will be understood from the following detailed description of the present invention accompanied with drawings.

DETAILED DESCRIPTION OF THE PREFERRED EMBODIMENTS

Figure 1:
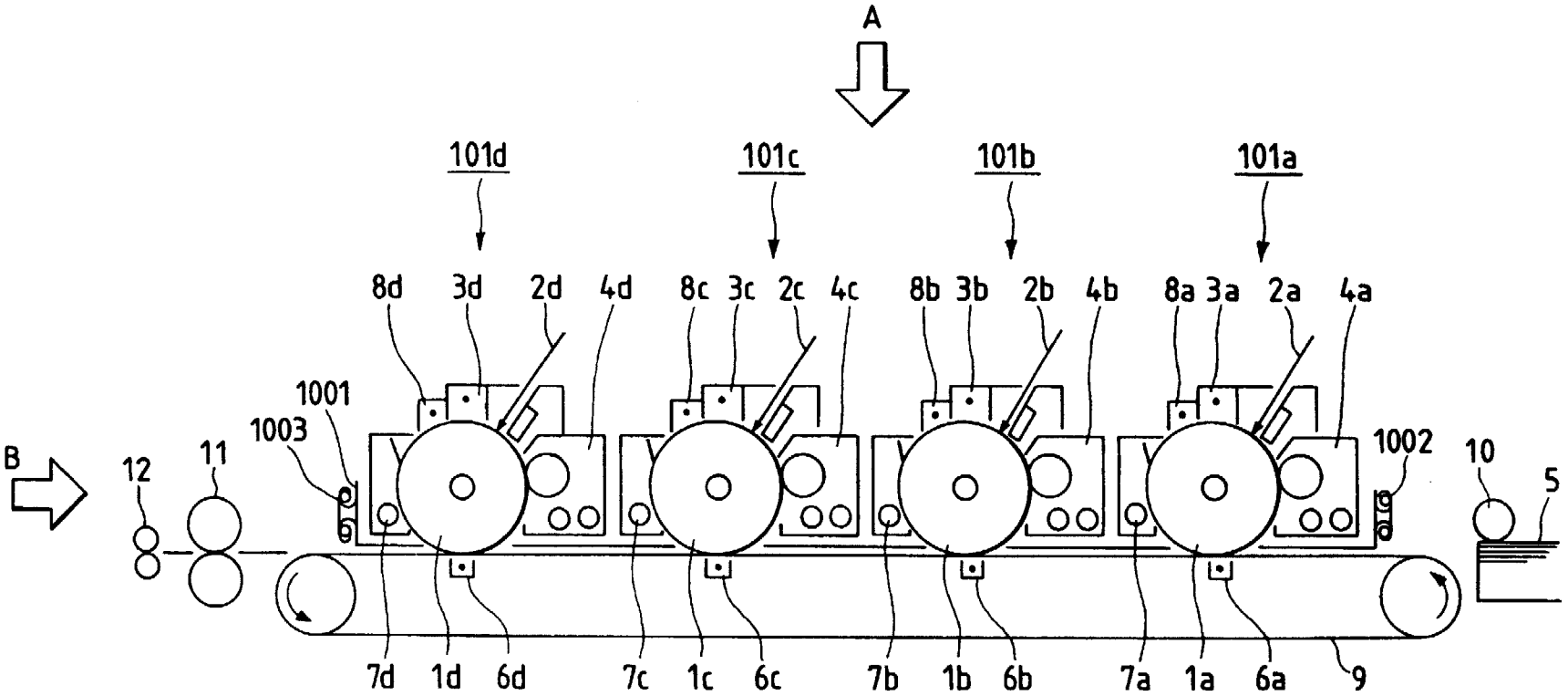
FIG. 1 is a schematic cross-sectional view of an image forming apparatus to which the present invention is applied.
Figure 2:
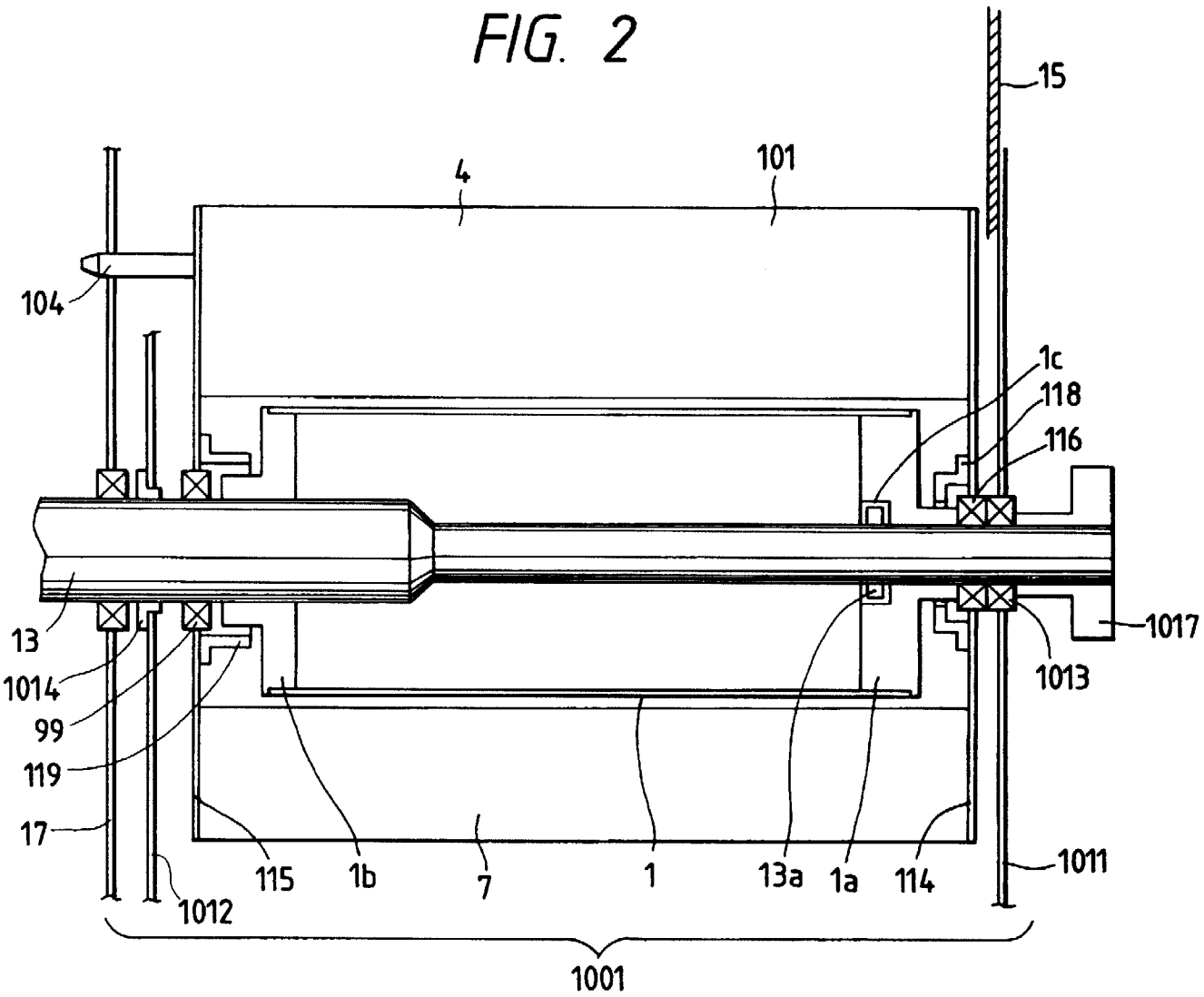
FIG. 2 is a cross-sectional view showing one of image forming stations of the image forming apparatus shown in FIG. 1, seen from the direction indicated by the arrow A in FIG. 1.
Figure 3:
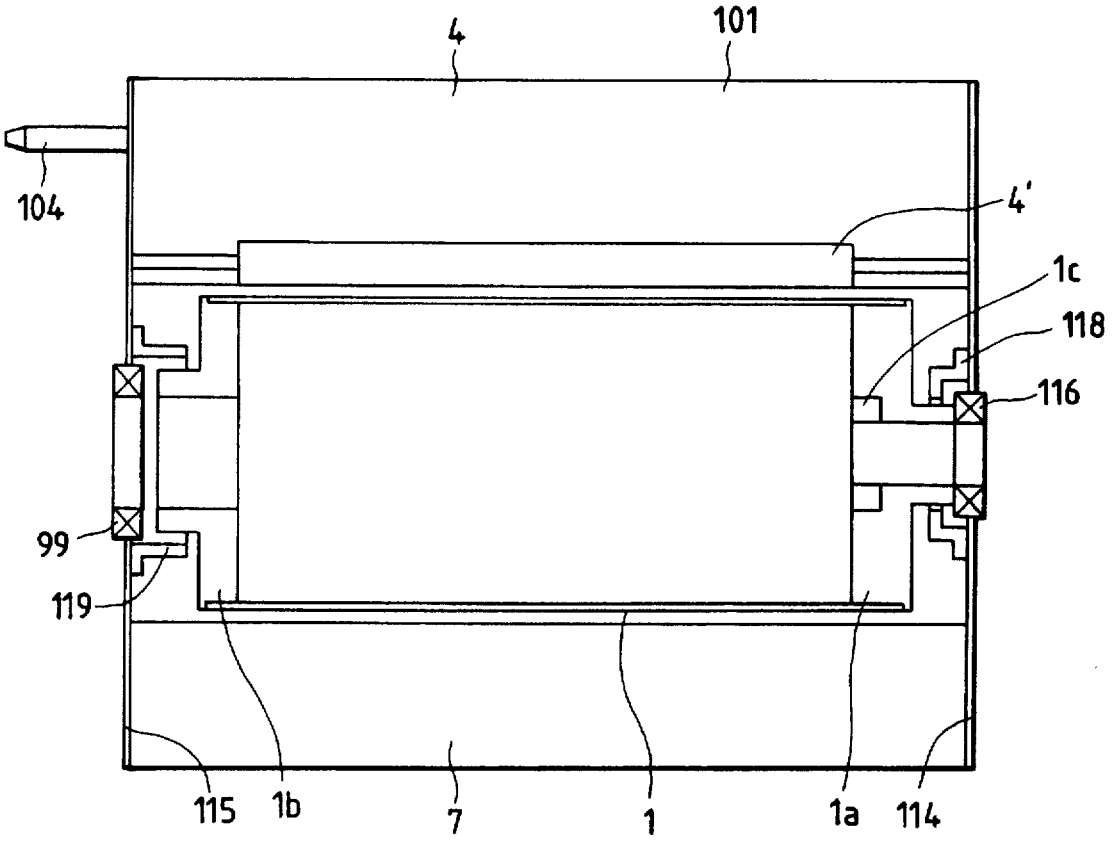
FIG. 3 is a cross-sectional view of a process unit dismounted from the apparatus main body.
Figure 4:
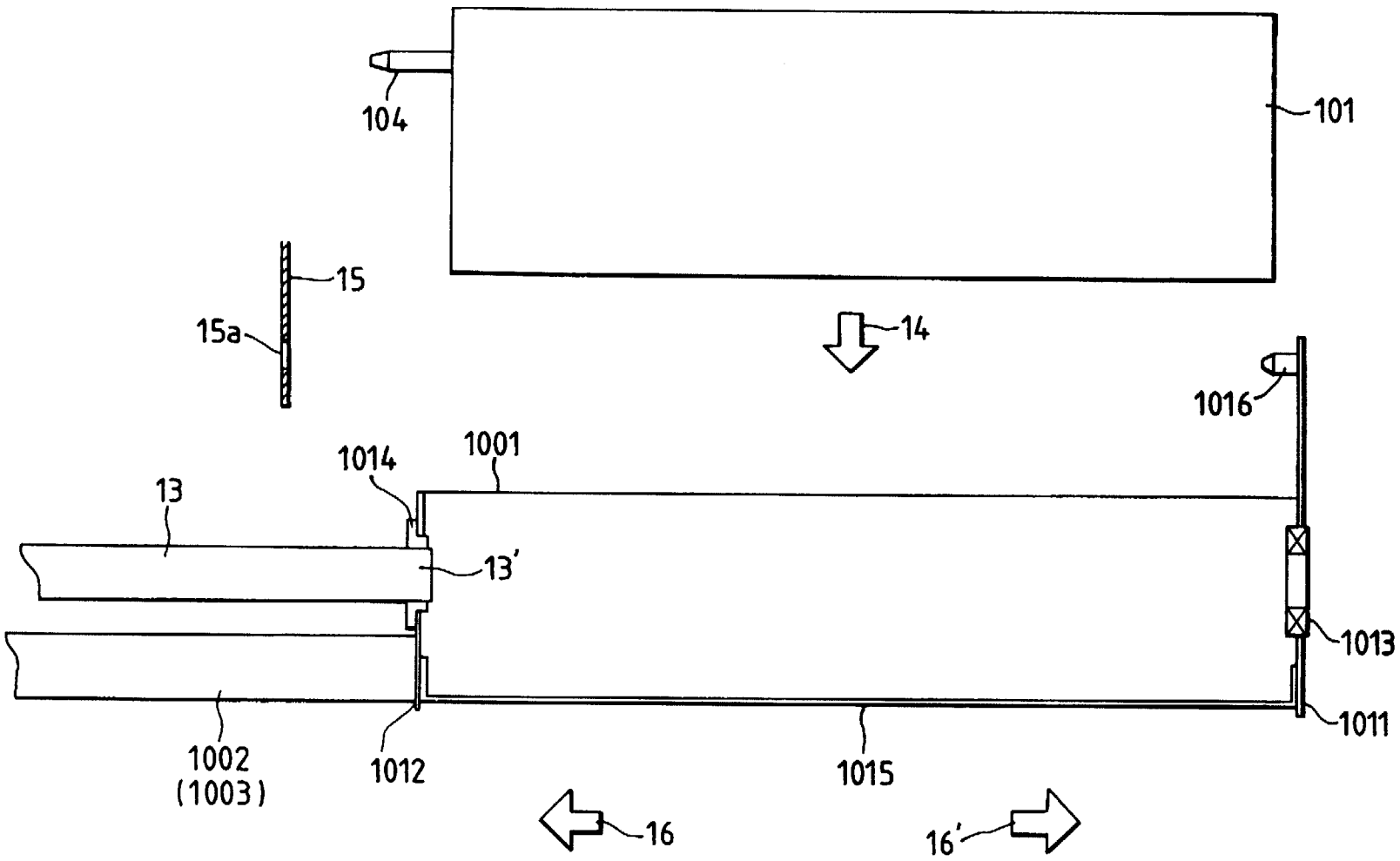
FIG. 4 is a view illustrating an image forming station seen from the direction indicated by the arrow B in FIG. 1, wherein the image forming station is drawn out from the apparatus so that the process unit can be mounted on the apparatus main body.
Figure 5:
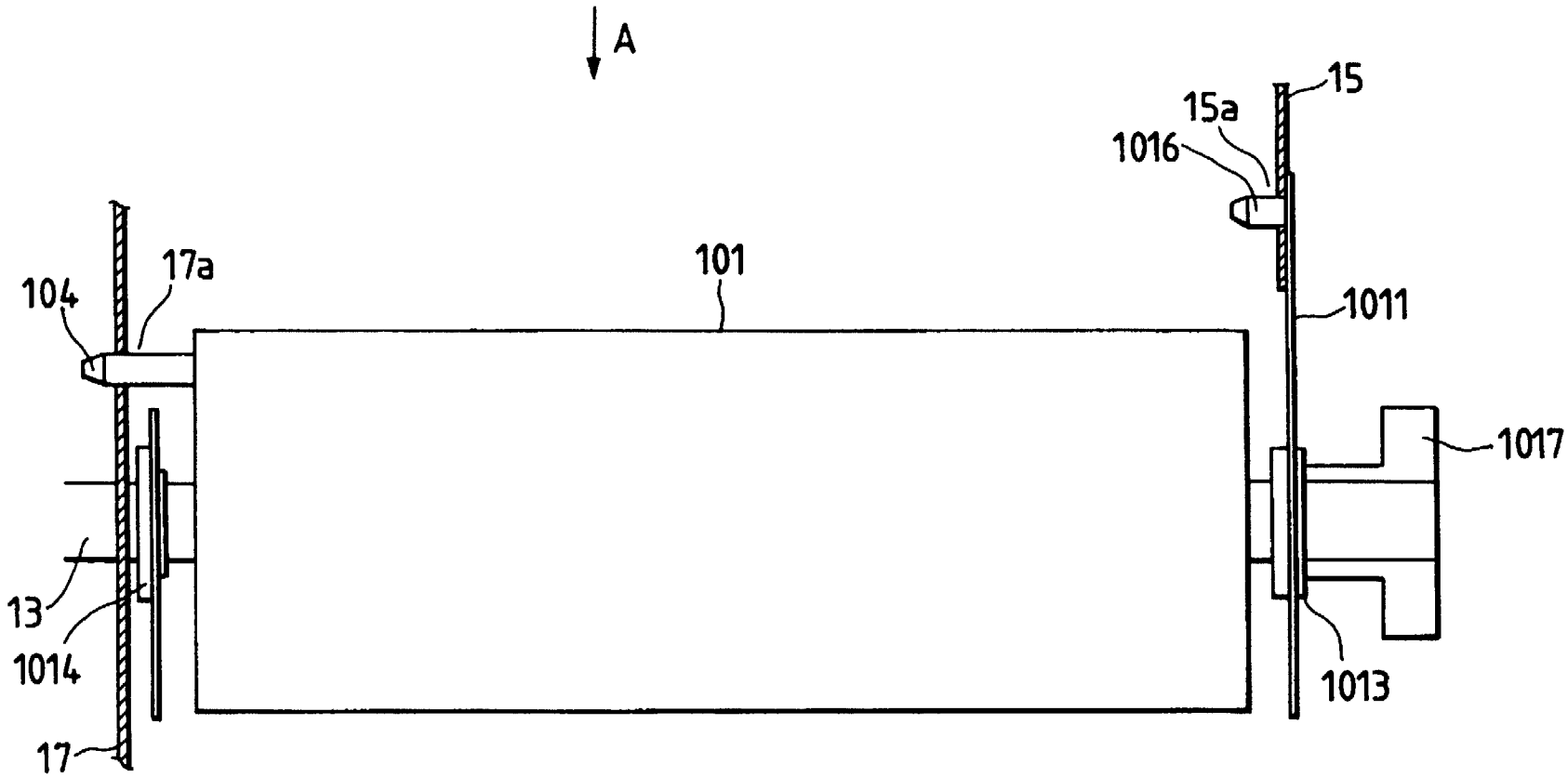
FIG. 5 is a view illustrating the process unit mounted on the apparatus main body, seen from the direction indicated by the arrow B in FIG. 1.

The first embodiment of the present invention will be described with reference to FIGS. 1 to 5. FIG. 1 is a schematic cross-sectional view of the image forming apparatus according to the present invention which has a plurality of image forming stations; FIG. 2 is a cross-sectional view showing one of the image forming stations of the image forming apparatus shown in FIG. 1, seen from the direction indicated by the arrow A in FIG. 1; FIG. 3 is a cross-sectional view of a process unit dismounted from the apparatus main body; FIG. 4 is a view showing an image forming station seen from the direction indicated by the arrow B in FIG. 1, wherein the image forming station is drawn out from the apparatus so that the process unit can be mounted on the apparatus main body; and FIG. 5 is a view showing the process unit mounted on the apparatus main body, seen from the direction indicated by the arrow B in FIG. 1.

First, the general construction of the image forming apparatus of this embodiment will be described with reference to FIG. 1. The image forming apparatus has four photosensitive drums 1 (that is, 1*a* to 1*d*) serving as image bearing bodies, which are separately aligned in the apparatus. These photosensitive drums 1 are illuminated with beams from respective laser scanning systems (not shown); reference numerals 2*a* to 2*d* denote the beams. Around each photosensitive drum 1, there are provided: a primary charger device 3 (3*a* to 3*d*) for charging the surface of the photosensitive drum 1 with electricity; a developer device 4 (4*a* to 4*d*, for magenta, cyan, yellow and black, respectively); a transfer device 6 (6*a* to 6*d*) for transferring the toner image borne by the photosensitive drum 1 onto a recording medium 5; a cleaner 7 (7*a* to 7*d*) for removing the residual toner on the photosensitive drum 1; and a charge clearing device 8 (8*a* to 8*d*) for clearing residual electric charge on the photosensitive drum 1. The photosensitive drums 1*a* to 1*d* together with the above-mentioned devices constitute respective image forming stations 101*a* to 101*d*.

In FIG. 1, a belt 9 serving as a conveyer means conveys the recording media 5 one by one to the transfer positions of respective photosensitive drums 1, a sheet supply means so supplies the recording medium 5 to the belt 9, a fixing means 11 fixes the toner images overlapped on the recording medium 5, and an eject means 12 ejects the recording medium 5 after fixation.

The image forming process of the image forming apparatus according to the present invention will be below.

First, the charger device 3 uniformly charges the surface of the photosensitive drum 1. Then, the charged surface of the photosensitive drum 1 is illuminated with the laser beam 2 corresponding to information of a color image. Thus, an electrostatic latent image is formed on the surface of the photosensitive drum 1. Subsequently, the toner contained in the developer device 4 is supplied to the photosensitive drum 1 to form a toner image on the photosensitive drum 1. The transfer charger device 6 transfers the toner image onto the recording medium 5 conveyed to the transfer position by the belt 9.

The four image forming stations 101 perform the above-mentioned operation in sequence, thereby overlapping the toner images of four colors on the recording medium 5. After that, the recording medium 5 passes through the fixing device 11 consisting of a pair of rollers to form a full-color image on the recording medium. Needless to say, it is not necessary to use all these four image forming stations 101. For example, this apparatus may also form a monochromatic image. After transferring the toner image onto the recording medium, the residual toner on the photosensitive drum 1 is removed by the cleaner, as well as the residual electric charge by the charge clearing device 8.

Among the components of the image forming station, the photosensitive drum 1 and the developer means 4 and the cleaner 7 which are used in the above-mentioned process as image forming means acting on said drum 1 are integrally supported as a unit 101 (hereinafter referred to as a "process unit"). Four process units 101 (101*a* to 101*d*), together with the other devices described before, constitute respective image forming stations: a first station for forming the magenta image, a second station for the cyan image, a third station for the yellow image and a fourth station for the black image to which the recording medium 5 is conveyed in sequence.

These four process units 101 are supported by a frame-shaped process unit supporter 1001. The process unit supporter 1001 is supported by rail members 1002 and 1003 (such as arcuride rails) which are protrusile from and retractile into the apparatus main body. Thus, the process unit supporter 1001 can be drawn out from the apparatus main body in the direction vertical to the page space (as indicated by the arrow 16' in FIG. 4). The process units 101 are mounted on or dismounted from the drawn-out supporter 1001 (they are mounted from the direction indicated by the arrow 14 in FIG. 4).

FIG. 4 shows the process unit supporter 1001 which is drawn out from the apparatus main body. In FIG. 4, a front plate 1011 of the process unit supporter 1001 and a back plate 1012 thereof are connected by a stay 1015. These three parts form a frame.

In FIG. 4, as described, the process unit supporter 1001 supported by the arcuride rails 1002 and 1003 is drawn out entirely from a front plate 15 of the apparatus main body, wherein the end 13' of a drum shaft (rotation shaft) 13 fixed to the apparatus main body engages in a shaft hole 1014 in a back plate 1012 of the process unit supporter 1001. The process unit 101 is set down as indicated by the arrow 14 to be mounted on the drawn-out process unit supporter 1011.

Subsequently, the supporter 1011 carrying four process unit 101 is moved in the direction indicated by the arrow 16 to position the process units 101 at predetermined positions, respectively.

As the process unit supporter 1001 carrying the four process units 101 for respective colors is moved in the direction of the arrow 16, a bearing 99 (see FIGS. 2 and 3) of the back plate 1012 of the process unit 101 is smoothly shifted along the drum shaft 13 fixed to the apparatus main body. When the process unit supporter 1001 is further pushed in the direction of the arrow 16, the drum shaft 13 pierces flanges 1*b* and 1*a* of the photosensitive drum 1, and then a bearing 1013 in the front plate 1011 of the process unit supporter 1001.

At the same time, a pin 1016 provided in the front plate 1011 of the process unit supporter 1001 engages with a hole 15*a* of the front plate 15 of the apparatus main body, as well as a pin 104 of the process unit 101 with a hole 17*a* of a back plate 17 of the apparatus main body (see FIGS. 2, 4 and 5). When the above-mentioned operation is completed, the process units 101 for respective colors are positioned with respect to respective drum shafts 13 and the apparatus main body.

As shown in FIG. 3, each process unit 101 comprises the photosensitive drum 1, the developer device 4, the cleaner 7 and the supporting members for supporting them such as the front and back plates, and so on. The bearings 116 and 99 are fit in the front plate 114 and the back plate 115 of the process unit 101, respectively. Here, the flanges 1*a* and 1*b* of the photosensitive drum 1 are supported, with play, by a drum supporter 118 fixed to the front plate 114 and a drum supporter 119 fixed to the back plate 115 of the process unit 101, respectively. Thus, the photosensitive drum 1 in the process unit 101 can shift in the direction vertical to that of the shaft.

When the process unit 101 is mounted on the apparatus main body as described above as shown in FIG. 2, the photosensitive drum 1 and the developer device 4 (with the cleaner 7) are separately positioned by the drum shaft 13. When the photosensitive drum 1 and the developer device 4 are positioned by the drum shaft 13, the distance between the photosensitive drum 1 and the developing device (developing sleeve) is fixed with respect to the direction vertical to the axis of the drum shaft 13.

In other words, when the developer device 4 (with the cleaner 7) in the process unit 101 is positioned through the bearings by the drum shaft 13, the photosensitive drum 1 is also positioned by the flanges 1*a* and 1*b* provided at respective ends of the photosensitive drum 1 which engage with the drum shaft 13. Thus, the developer device 4 (with the cleaner 7) and the photosensitive drum 1 in the process unit 101 are separately positioned by the drum shaft 13. Incidentally, the bearings 116 and 99 may be either ball bearings or slide bearings. As described, in the process unit 101, the positions of the developer device 4 and the cleaner 7 with respect to the photosensitive drum 1 (that is, the clearance between the developer sleeve of the developer device 4, and the contact pressure and the contact angle of the cleaning blade of the cleaner 7) are determined with high precision.

Also, in the above-mentioned construction, since the developer sleeve can be supported in the process unit 101 without contact with the photosensitive drum 1, the driving force which rotates the developer sleeve 4' of the developer device 4 does not act as the load preventing stationary rotation of the photosensitive drum 1. In addition, the mechanical vibration caused when the process unit 101 is driven is not directly transmitted to the photosensitive drum 1. Therefore, defects such as non-uniformity of the image pitch, blurred colors and irregularity in colors can be prevented to provide an image of good quality.

Note that, in FIG. 2, the drum supporters 118 and 119, respectively fixed to the plates 114 and 115 of the process unit 101, prevent the photosensitive drum 1 from detaching from the process unit 101 which is dismounted from the process unit supporter 1001. As shown in FIG. 2, the photosensitive drum 1 in the process unit 101 is separated from the drum supporters 118 and 119. More specifically, the photosensitive drum 1 loosely engages with the drum supporters 118 and 119 is separated from them by the drum shaft 13 engaging with the photosensitive drum 1 when the process unit 101 is mounted on the apparatus main body.

A pin 13*a* provided on the drum shaft 13 is a driving pin for transmitting torque of the drum shaft 13 to the photosensitive drum 1. When the process unit 101 is mounted on the apparatus main body, said pin 13*a* is held by a recess 1*c* of the front flange 1*a* of the photosensitive drum 1. A driving source (not shown) provided in the apparatus main body supplies torque to the drum shaft 13 and rotates it. Also, when the process unit 101 is mounted on the apparatus main body, the same driving source which rotates the drum shaft 13 also gives torque to the developer sleeve 4' (see FIG. 3) in the developer device 4 to rotate it. Note that the developer sleeve 4' does not receive torque from the drum shaft 13 but the torque to rotate the developer sleeve 4' is transmitted via a route other than the drum shaft 13.

Accordingly, torque does not have to be transmitted directly between the photosensitive drum 1 and the developer sleeve 4', nor do contact rollers have to be provided to the developer sleeve 4' to adjust the clearance between the surface of the photosensitive drum 1 and that of the developer sleeve 4' to a predetermined value. So, the surface of the developer sleeve 4' (which is a rotating body) does not come into contact with the surface of the photosensitive drum at all (see FIG. 3).

The pin 1016 (see FIGS. 4 and 5) fixes the process unit supporter 1001 to the apparatus main body, while the pin 104 (see FIGS. 2 to 5) fixes the process unit 101 to the apparatus main body so that the process unit 101 may not be rotated while the drum shaft 13 is rotated.

In the first embodiment described above, the image bearing body and the image forming means for forming the image on the image bearing body are integrated as a unit which can be detachably mounted on the apparatus main body.

But, in the second embodiment described below, the image bearing body and the image forming means which are detachably mounted on the apparatus main body are separated. In this case, these components can be more economically used, for, if the useful life of one of the components expires, is shorter than that of the other, the other does not have to be disposed when the first component is replaced. Incidentally, in the following description, members having the same functions as those in the first embodiment will be denoted by the same referential numerals.

Figure 6:
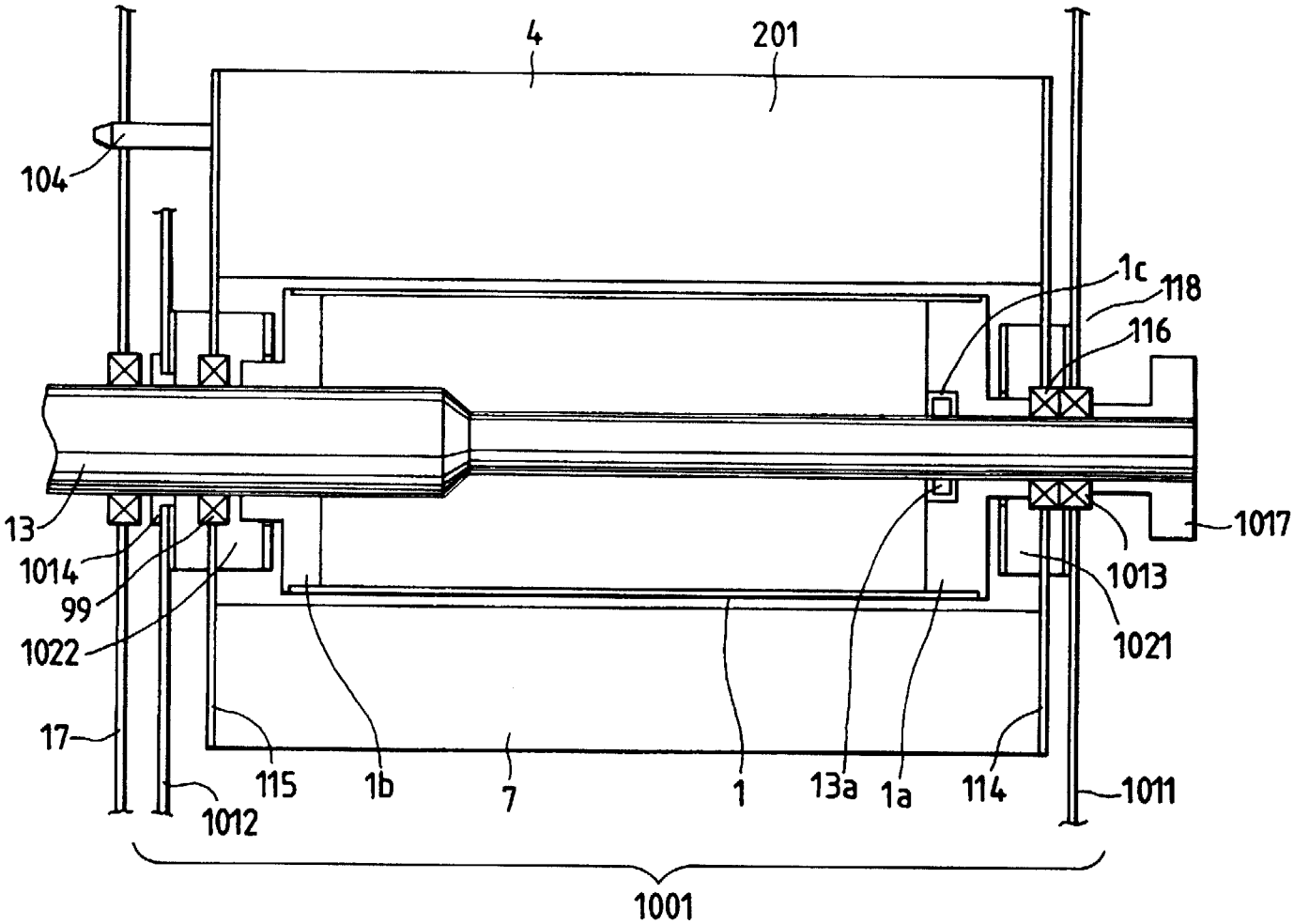
FIG. 6 is a cross-sectional view of an image forming station of the second embodiment of the image forming apparatus according to the present invention; seen from the direction indicated by the arrow A in FIG. 1.
Figure 7:
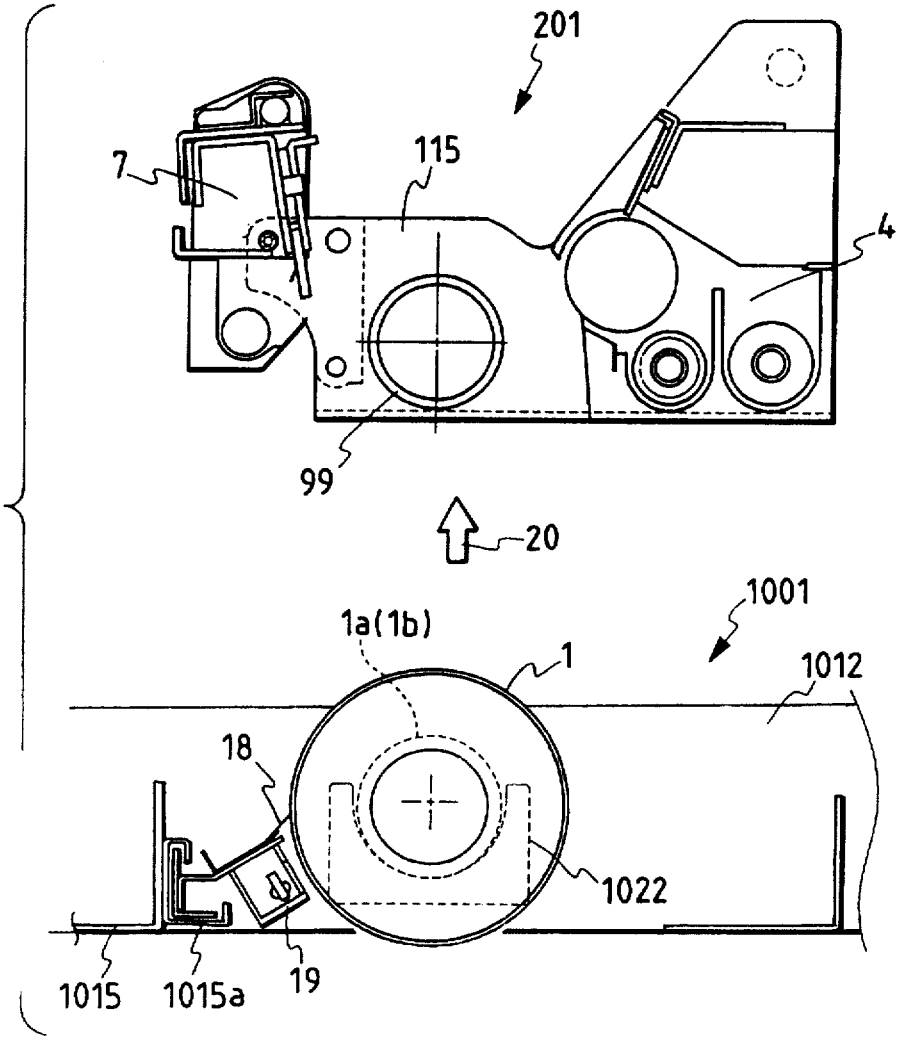
FIG. 7 is a view illustrating a developer-cleaner unit of the second embodiment of the image forming apparatus according to the present invention, wherein the developer-cleaner unit is dismounted from the apparatus main body.
Figure 8:
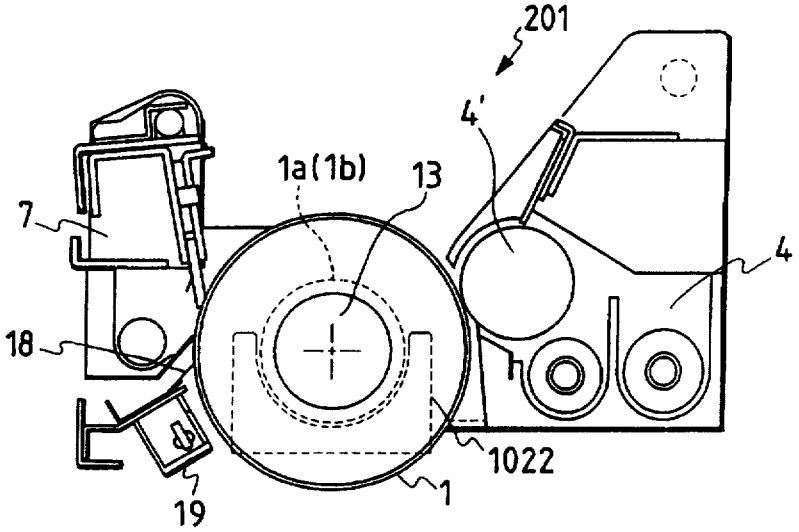
FIG. 8 is a view illustrating the developer-cleaner unit and a photosensitive drum which are mounted on the apparatus main body.

In FIGS. 6 to 8, the developer device 4 and the cleaner 7 are integrated as a unit 201 (hereinafter referred to as "developer-cleaner unit"). Four developer-cleaner units 201 are supported by a frame-shaped supporter 1001. The frame supporter 1001 is supported by the rail members 1002 and 1003 (such as arcuride rails) which are protrusile from and retractile into the apparatus main body.

The frame supporter 1001 can be drawn out from the apparatus main body. The developer-cleaner unit 201 and the photosensitive drum 1, which are separately prepared, can be detachably mounted on the frame supporter 1001 which is drawn out from the apparatus main body.

The second embodiment differs from the first embodiment in that the developer-cleaner unit 201 can be pulled in the direction vertical to that of the drum shaft 13 and dismounted from the drawn-out frame supporter 1001 while the photosensitive drum 1 is still in the frame supporter 1001.

In FIG. 6, drum supporters 1021 and 1022 which are fixed to the front plate 1011 and the back plate 1012 of the frame supporter 1001, respectively, support the photosensitive drum 1 loosely so that the photosensitive drum 1 can move in the direction vertical to that of the drum shaft 13.

FIG. 7 shows the developer-cleaner unit 201 which is lifted up (as indicated by the arrow 20) from the drawn-out frame supporter 1001, wherein the photosensitive drum 1 is supported with bosses of its drum flanges 1*a* and 1*b* caught in U-shaped recesses of respective drum supporters 1021 and 1022 fixed to the frame supporter 1001.

In other words, the drum supporters 1021 and 1022 only support the photosensitive drum 1 when the frame supporter 1001 is drawn out from the apparatus main body, but do not position the photosensitive drum 1. So, when the frame supporter 1001 is drawn out from the apparatus main body, the bosses of the flanges 1*a* and 1*b* of the photosensitive drum 1 are placed on (that is, come into contact with) respective drum supporters 1021 and 1022.

In FIG. 8, the frame supporter 1001 carrying the photosensitive drum 1 and the developer-cleaner unit 201 is moved into the apparatus main body to mount the photosensitive drum 1 and the developer-cleaner unit 201 on the apparatus main body. Here, as the photosensitive drum 1 is positioned by the drum flanges 1*a* and 1*b* engaging with the drum shaft 13 which is fixed to the apparatus main body, the bosses of the drum flanges 1*a* and 1*b* are detached from the U-shaped recesses of the drum supporters 1021 and 1022.

In FIG. 8, a dip sheet 18 collects the toner which remains on the blade of the cleaner 7 and drops therefrom when the developer-cleaner unit 201 is dismounted (see FIG. 7). A density sensor 19 detects density of the image developed on the photosensitive drum 1. Conditions of the image forming process are varied and corrected according to the output of the density sensor 18 in order to obtain the Dmax, linearity of the density, and so on.

In this second embodiment, the dip sheet 18 prevents the toner on the cleaner 7 from dropping on and blotting the density sensor 18. The dip sheet 18 and the density sensor 19 are integrated as a unit, which can be moved along a rail 1015*a* of the stay 1015 of the frame supporter 1001 in the direction of the drum shaft 13 to be dismounted.

The photosensitive drum 1 mounted as shown in FIG. 7 can be pulled up in the direction of the arrow 20 to be dismounted. The photosensitive drum 1 and the developer-cleaner unit 201 can be mounted again on the apparatus main body in reverse order. After mounting the photosensitive drum 1 and the developer-cleaner unit 201 on the frame supporter 1001, the frame supporter 1001 is shifted into the apparatus main body to be at the position shown in FIGS. 6 and 8 in the same manner as in the first embodiment, whose description will not be repeated here.

In the second embodiment, like in the first embodiment, the developer-cleaner unit 201 is positioned by the drum shaft 13 with the bearings 116 and 99 therebetween. At the same time, the photosensitive drum 1 is positioned by the drum shaft 13, wherein the drum flanges 1*a* and 1*b* provided at respective ends of the photosensitive drum 1 engage with the drum shaft 13. Thus, the developer-cleaner unit 201 and the photosensitive drum 1 are separately positioned by the drum shaft 13.

Incidentally, the photosensitive drum 1 and the developer sleeve 4' in the developer device 4 are driven in the same manner as in the first embodiment.

So, the developer sleeve 4' does not receive torque from the drum shaft 13, but the torque transmitted via the route other than the drum shaft 13. Accordingly, torque does not have to be transmitted directly between the photosensitive drum 1 and the developer sleeve 4', nor are contact rollers provided to the developer sleeve 4' to adjust the clearance between the surface of the photosensitive drum 1 and that of the developer sleeve 4' to a predetermined value. The surface of the developer sleeve 4' (which is a rotating body) does not come into contact with the surface of the photosensitive drum at all.

As described above, the image forming apparatus according to the present invention has the shaft in its main body to support the image bearing body, and the shaft separately positions the image bearing body and the image forming means when they are mounted on their respective positions in the apparatus main body. Accordingly, the mechanical vibration caused in the image forming means is not easily transmitted to the image bearing body. When the present invention is applied to a full-color image forming apparatus which overlaps a plurality of developed images of different colors on the same recording medium, the full-color image can not be easily blurred. In addition, according to the present invention, the distance between the image bearing body and the image forming means can be easily fixed at a predetermined value simply by mounting the image bearing body and the image forming means properly on the apparatus main body, wherein no spacer roller is required.

Note that the present invention is not limited to the above-mentioned embodiments but includes all the modifications which fall within the range of the technical ideas of the present invention.

What is claimed is:

1. An image forming apparatus, comprising:

a rotatable image bearing member detachably mounted on a main body of said image forming apparatus;

a shaft for supporting and positioning said image bearing member relative to the main body;

image forming means for forming an image on said image bearing member, said image forming means comprising a frame having bearings supported by said shaft and being detachably mounted on the main body and positioned relative to said shaft.

2. An image forming apparatus according to claim 1, wherein the main body of said apparatus comprises a driving source for supplying torque to said shaft to rotate said shaft while said image bearing member is rotated by the rotation of said shaft.

3. An image forming apparatus according to claim 1, wherein a distance between said image bearing member and said image forming means in a direction vertical to an axis of said shaft is fixed when said image bearing member and said image forming means are supported by said shaft.

4. An image forming apparatus according to claim 1, further comprising a frame-shaped supporter which can be drawn out from the main body in direction of an axis of said shaft;

wherein said image bearing member and said image forming means are loosely supported in said frame-shaped supporter so that said image bearing member and said image forming means can move in a direction vertical to the axis of said shaft when said frame-shaped supporter is drawn out from the main body.

5. An image forming apparatus according to claim 1, wherein said image forming means comprises a developing device for supplying developer to said image bearing member, and said developing device comprises a rotating body for bearing the developer.

6. An image forming apparatus according to claim 5, wherein said rotating body of said developing device comprises a sleeve.

7. An image forming apparatus according to claim 5, wherein surface of said rotating body does not come into contact with a surface of said image bearing member when said image bearing member and said developing device are mounted at respective positions in the main body of said apparatus.

8. An image forming apparatus according to claim 2, wherein said image forming apparatus comprises a moving body which is moved by a driving force generated by said driving source in the main body of said apparatus and transmitted through a member other than said shaft.

9. An image forming apparatus according to claim 1, wherein said image bearing member and said image forming means are separately mounted on and dismounted from the main body.

10. An image forming apparatus according to claim 1, wherein said image bearing member and said image forming means form an integrated unit which is detachably mounted on the main body of said apparatus, and said image bearing member in the unit can move in a direction vertical to an axis of the image bearing member.

11. An image forming apparatus, comprising a first, second, third, and fourth image forming stations, each of said image forming stations including:

a rotatable image bearing member detachably mounted on a main body of said image forming apparatus;

a shaft for supporting and positioning said image bearing member relative to the main body; and image forming means for forming an image on said image bearing member, said image bearing member comprising a frame having bearings supported by said shaft and being detachably mounted on the main body and positioned relative to said shaft, wherein said first, second, third, and fourth image forming stations are disposed above a convey belt conveying a recording medium.

12. An image forming apparatus according to claim 11, wherein the main body of said apparatus comprises a driving source for supplying torque to said shaft to rotate said shaft while said image bearing member is rotated by the rotation of said shaft.

13. An image forming apparatus according to claim 11, wherein a distance between said image bearing member and said image forming means in a direction vertical to an axis of said shaft is fixed when said image bearing member and said image forming means are supported by said shaft.

14. An image forming apparatus according to claim 11, further comprising a frame-shaped supporter which can be drawn out from the main body in a direction of an axis of said shaft;

wherein said image bearing member and said image forming means are loosely supported in said frame-shaped supporter so that said image bearing member and said image forming means can move in a direction vertical to the axis of said shaft when said frame-shaped supporter is drawn out from the main body.

15. An image forming apparatus according to claim 11, wherein said image forming means comprises a developing device for supplying developer to said image bearing member, and said developing device comprises a rotating body for bearing the developer.

16. An image forming apparatus according to claim 15, wherein said rotating body of said developing device comprises a sleeve.

17. An image forming apparatus according to claim 15, wherein a surface of said rotating body does not come into contact with a surface of said image bearing member when said image bearing member and said developing device are mounted at respective positions in the main body of said apparatus.

18. An image forming apparatus according to claim 12, wherein said image forming apparatus comprises a moving body which is moved by a driving force generated by said driving source in the main body of said apparatus and transmitted through a member other than said shaft.

19. An image forming apparatus according to claim 11, wherein said image bearing member and said image forming means are separately mounted on and dismounted from the main body.

20. An image forming apparatus according to claim 11, wherein said image bearing member and said image forming means form an integrated unit which is detachably mounted on the main body of said apparatus, and said image bearing member in the unit can move in a direction vertical to an axis of the image bearing member.

21. An image forming apparatus according to claim 11, wherein said first image forming station forms a magenta toner image on said image bearing member.

22. An image forming apparatus according to claim 11, wherein said second image forming station forms a cyan toner image on said image bearing member.

23. An image forming apparatus according to claim 11, wherein said third image forming station forms a yellow toner image on said image bearing member.

24. An image forming apparatus according to claim 11, wherein said fourth image forming station forms a black toner image on said image bearing member.

* * * * *

UNITED STATES PATENT AND TRADEMARK OFFICE

CERTIFICATE OF CORRECTION

PATENT NO. : 5,534,972

DATED : July 9, 1996

INVENTOR(S) : AKIO OHNO

It is certified that error appears in the above-indentified patent and that said Letters Patent is hereby corrected as shown below:

[57] ABSTRACT

Line 5, change "have bearings for supporting" to — have bearings supported by —.

COLUMN 6

Line 6, delete "expires,".

COLUMN 8

Line 15, change "in" to --in a--; and
Line 32, change "wherein" to --wherein a--.

Signed and Sealed this

Tenth Day of December, 1996

*Attest:*

Bruce Lehman

BRUCE LEHMAN

*Attesting Officer*

*Commissioner of Patents and Trademarks*